US007730571B2

(12) United States Patent
Libman

(10) Patent No.: US 7,730,571 B2
(45) Date of Patent: Jun. 8, 2010

(54) PUSH BROOM BRACKET ASSEMBLY

(75) Inventor: Robert J. Libman, Arcola, IL (US)

(73) Assignee: The Libman Company, Arcola, IL (US)

( * ) Notice: Subject to any disclaimer, the term of this patent is extended or adjusted under 35 U.S.C. 154(b) by 1210 days.

(21) Appl. No.: 11/275,141

(22) Filed: Dec. 14, 2005

(65) Prior Publication Data

US 2007/0000080 A1 Jan. 4, 2007

Related U.S. Application Data

(60) Provisional application No. 60/636,254, filed on Dec. 14, 2004.

(51) Int. Cl.
*A46B 15/00* (2006.01)
*B25G 3/00* (2006.01)

(52) U.S. Cl. ..... 15/145; 15/146; 16/422

(58) Field of Classification Search ..... 15/145, 15/111, 146; 16/422

See application file for complete search history.

(56) References Cited

U.S. PATENT DOCUMENTS 1,761,180 A * 6/1930 Cave et al. ..... 15/117
1,947,697 A * 2/1934 Cohen ..... 403/198
1,983,923 A * 12/1934 Stevens et al. ..... 403/198
2,312,086 A * 2/1943 Feldman ..... 15/146
2,390,705 A * 12/1945 Haase ..... 403/190
3,619,845 A * 11/1971 Partridge et al. ..... 15/117
4,194,259 A 3/1980 Bauman
4,538,318 A 9/1985 Lammert et al.
4,763,378 A 8/1988 Drumm
5,094,564 A 3/1992 Tedrick
5,502,862 A 4/1996 Vosbikian
6,523,212 B2 2/2003 Cesak

* cited by examiner

*Primary Examiner*—Randall Chin
(74) *Attorney, Agent, or Firm*—Banner & Witcoff, Ltd.

(57) ABSTRACT

A bracket assembly for use with cleaning implements such as push brooms has a handle connector for mounting a handle and a plate with a pair of depending flanges that are inserted into the broom head. The bracket assembly may be removably secured to the broom head with a fastener such as bolt and nut to provide an attachment mechanism having sufficient strength to withstand repeated sweeping motion. The removable bracket allows the arrangement of the handle and broom head to be reversed so that both faces of the broom head and bristles can be used interchangeably for sweeping. The removable bracket can be used with cleaning implements having heads of various dimensions and shapes.

10 Claims, 4 Drawing Sheets

PUSH BROOM BRACKET ASSEMBLY

This application claims the benefit of U.S. Provisional Application No. 60/636,254, filed on Dec. 14, 2004, which is incorporated by reference in its entirety herein.

FIELD OF THE INVENTION

The embodiments of the present invention relate to cleaning implements such as push brooms and the like. More particularly, the various embodiments relate to a bracket assembly for removably but securely connecting a handle to a head of a cleaning implement in one or more orientations.

BACKGROUND OF THE INVENTION

Brooms sometimes are classified as either "push" brooms or "upright" brooms. Upright brooms are often wide and generally have relatively long bristles, typically extending from a shroud or broom head. An elongated handle having a central longitudinal axis aligned with the bristles may facilitate side-to-side sweeping of the upright broom. An end of the handle may be permanently secured within an opening in the broom head.

Push brooms generally have relatively short bristles, which may be set in a wide block, or broom head. The broom head is generally rectangular. An elongated handle may extend upwardly from the broom head and be set at an angle to facilitate pushing the broom, with a long side of the broom head facing in the direction of sweeping. Push brooms often have detachable handles. A detachable handle facilitates shipping of the brooms. Additionally, depending on the configuration of the broom head, a detachable handle can permit the handle to be mounted on the broom head in the opposite direction, and thus allow sweeping in reverse direction to prolong the life of the bristles.

Conventionally, detachable handles are connected to broom heads by screwing a threaded end of the handle into a threaded aperture in the broom head. For some time, it has been known that, with such brooms, the handle has a tendency to rotate and loosen during use. Various efforts have been made to avoid this and other problems.

U.S. Pat. No. 4,194,259 discloses an industrial push broom that includes an attachment means for connecting the handle to the back of the push broom. A first flange of the attachment means is fastened to the top face of the broom, and a second flange is fastened to the rear edge of the broom. The handle extends from the intersection of the rear edge and the top face. The positioning of the attachment means is fixed with respect to the back of the broom.

U.S. Pat. No. 5,094,564 discloses a brush block assembly with latching means for maintaining the handle in an interlocked position. One end of the handle extends into a hole in the broom block. The positioning of the brush block assembly is fixed with respect to the broom block.

There remains a need for improved features for the mounting bracket assembly for a push broom to facilitate replacement of the handle and broom head and to allow changing of the positioning of the handle.

SUMMARY OF THE INVENTION

A push broom having a bracket assembly for securely attaching a handle to a broom head provides a strong and durable push broom with a handle that will not loosen with use. The bracket assembly allows the position of the handle to be reversed to extend first from the back face of the broom head then from the front face of the broom head. Reversing the position of the handle enables the back face of the broom head to be moved to the front and utilized for sweeping, particularly when the bristles along the front face of the broom head become worn or bent. The bracket assembly also is reusable and allows replacement of the handle and broom head separate from one another when needed. Broom heads of different widths also can be used with the bracket assembly.

The resulting push broom is simple to manufacture and easy to assemble, disassemble, and reassemble than previously-known brooms. Further advantages of the invention should be apparent to those skilled in the art upon reviewing the following detailed description in conjunction with the accompanying drawings.

BRIEF DESCRIPTION OF THE DRAWINGS

In the detailed description which follows, reference will be made to the drawings comprised of the following figures.

DETAILED DESCRIPTION OF THE PREFERRED EMBODIMENTS

Figure 1:
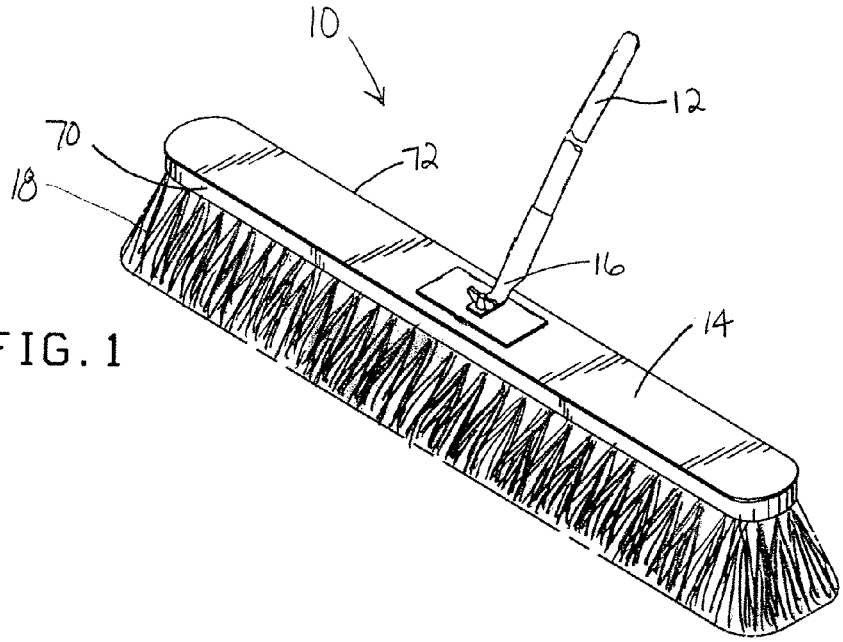
FIG. 1 is a fragmentary perspective view of a push broom in accordance with an embodiment of the invention.

Referring to FIG. 1, a push broom 10 is shown. The push broom 10 generally includes an elongated handle 12, a broom head 14 and a bracket assembly 16 to connect the handle 12 to the broom head 14. In FIG. 1, the broom head 14 is rectangular and has a front face 70 and a rear face 72. Although the bracket assembly 16 is shown and described herein in connection with a push broom, the bracket assembly also could be used with other cleaning implements that are pushed forward and pulled back during use, including mops, dusters, sweepers and the like, and such use is contemplated as being within the scope of the invention.

As depicted, the broom head 14 includes a plurality of bristles 18 for sweeping. The bristles 18 can be of any desired length and density and can be of a natural or man-made composition, including but not limited to natural hairs, natural fibers, polymeric or other synthetic fibers and metallic bristles. The bristles 18 can be mounted to the broom head 14 in any conventional, or other convenient, way. As illustrated, the bristles are grouped in tufts and mounted into holes (not shown) in the bottom surface 17 of the broom head.

Figure 2:
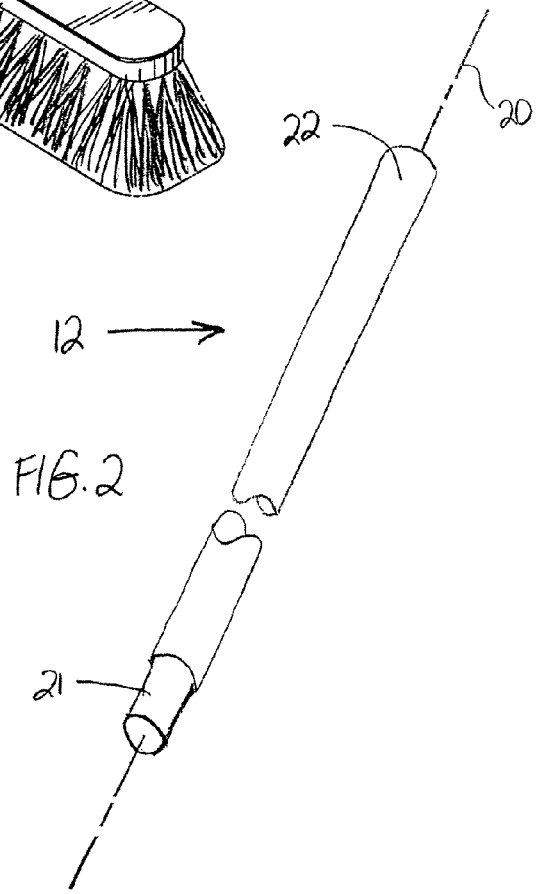
FIG. 2 is a fragmentary perspective view of the handle of the push broom of FIG. 1.

As seen in FIG. 2, the handle 12 has a central axis 20, a mounting end 21, and a distal end 22. The handle can be made of any conventional material (such as plastic, metal, or wood) and have any conventional or otherwise convenient length and configuration. Although the illustrated handle is straight, it could also have one or more bends or curves for added convenience or ease of use and have a different length and diameter. It could also have a shaped handgrip or hanger tip at the distal end 22.

As is commonly known, broom bristles can become bent or worn after repeated use in one direction. Thus, it is desirable to be able to periodically reverse the handle direction to allow sweeping with the opposite face of the broom head as the leading face during sweeping. The bracket assembly 16 for mounting the handle 12 to the broom head 14 is readily removable and rotatable to enable this to be done.

Figure 3:
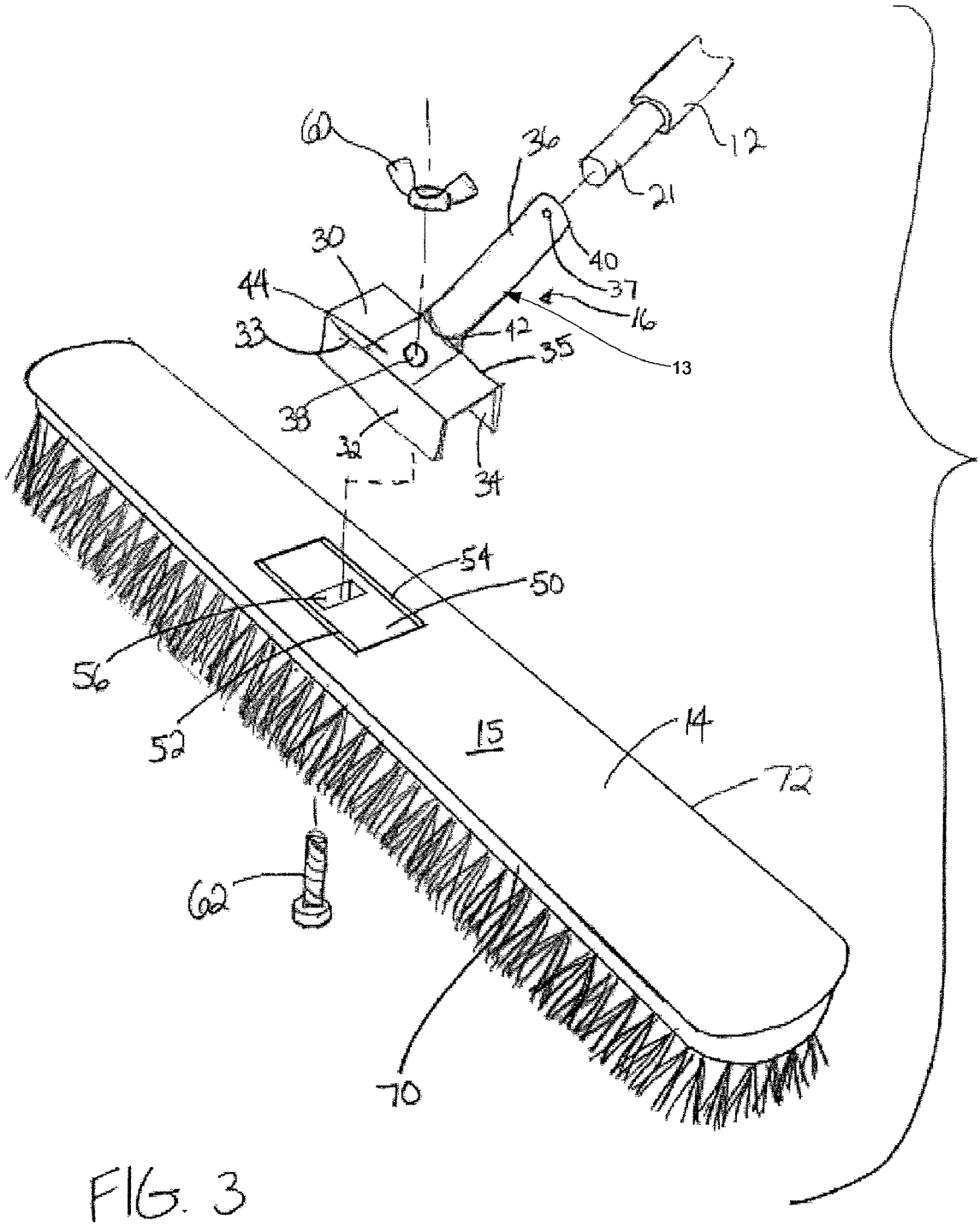
FIG. 3 is an exploded view of the push broom of FIG. 1.

Referring also to FIG. 3, the bracket assembly 16 includes a plate 30 having a first edge 33 and a second edge 35. A first flange 32 extends downwardly from the first edge 33 and a second flange 34 extends downwardly from the second edge 35. In an embodiment, the first flange 32 and the second flange 34 may extend generally perpendicularly to the plate 30 and generally parallel to each other. The plate 30 is of a shape and size that correspond with a receiving portion 50 in the top surface 15 of the broom head 14 so that plate 30 nestably engages receiving portion 50. The first and second flanges 32 and 34 are of a width and thickness to fit within open slots 52 and 54, respectively, in the receiving portion 50. The flanges 32 and 34 may be of any suitable length. In an embodiment, the length of the flanges 32, 34 may be configured so that they extend a substantial depth into the slots 52 and 54 for engaging the broom head. This arrangement securely engages the bracket assembly 16 with the broom head 14 (FIG. 7) and provides improved stability of the bracket assembly 16 against the forces associated with sweeping. Bracket assembly 16 can be fabricated of metal, molded polymeric material or other strong, durable material. In addition, the bracket may include more or fewer flanges in similar or different arrangements than depicted. Flanges may also be disposed at angles other than the substantially perpendicular angle illustrated in FIG. 3.

Figure 4:
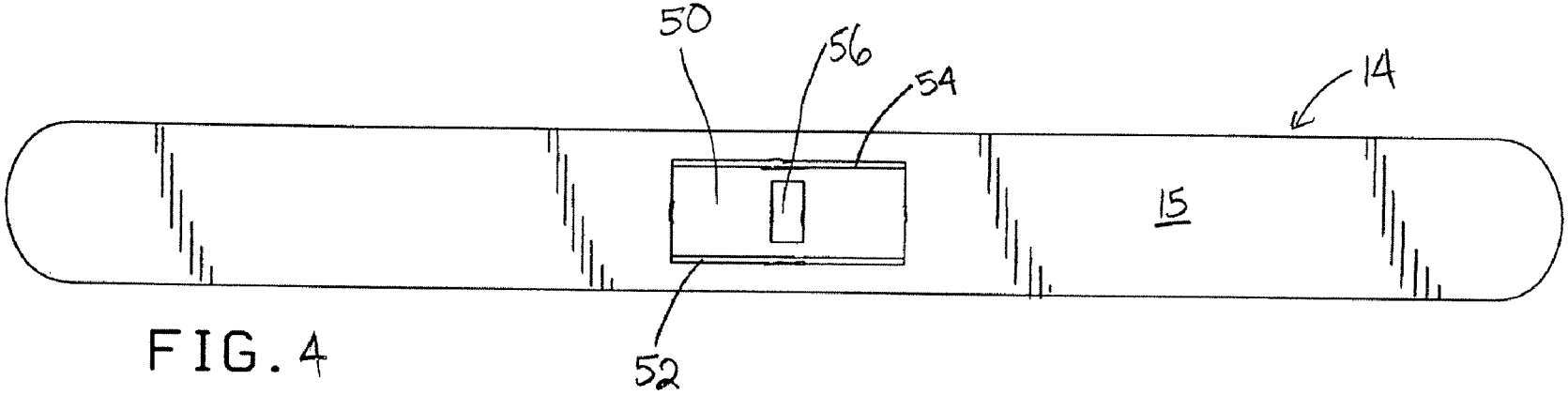
FIG. 4 is a top plan view of the broom head of the push broom of FIG. 1.
Figure 5:
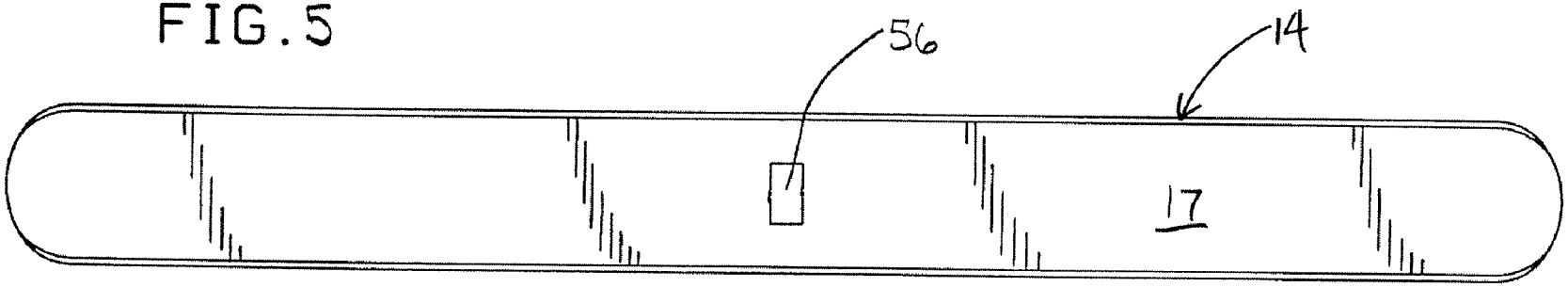
FIG. 5 is a bottom plan view of the broom head of the push broom of FIG. 1 with the bristles removed.

As best seen in FIGS. 4 and 5, the receiving portion 50 also includes an opening 56 through the entire thickness between a top surface 15 and a bottom surface 17 of the broom head 14. The opening 56 is shown as rectangular in shape but also can be any other shape. In an embodiment, the opening 56 is an elongated opening to accommodate variations in the configuration of the bracket assembly, including positioning of the opening 38 and the bolt 62 relative to the broom head 14. In an alternative embodiment, the fastener 62 may be formed as a part of or with the broom head 14 so that it extends upward from the top surface 14 of the broom head. In another alternative embodiment, the opening 56 may be threaded or otherwise shaped so as to correspond with the fastener configured to extend through the broom head 14. As can be appreciated, numerous variations exist in how the bracket assembly 16 and broom head 14 are connected together.

Figure 6:
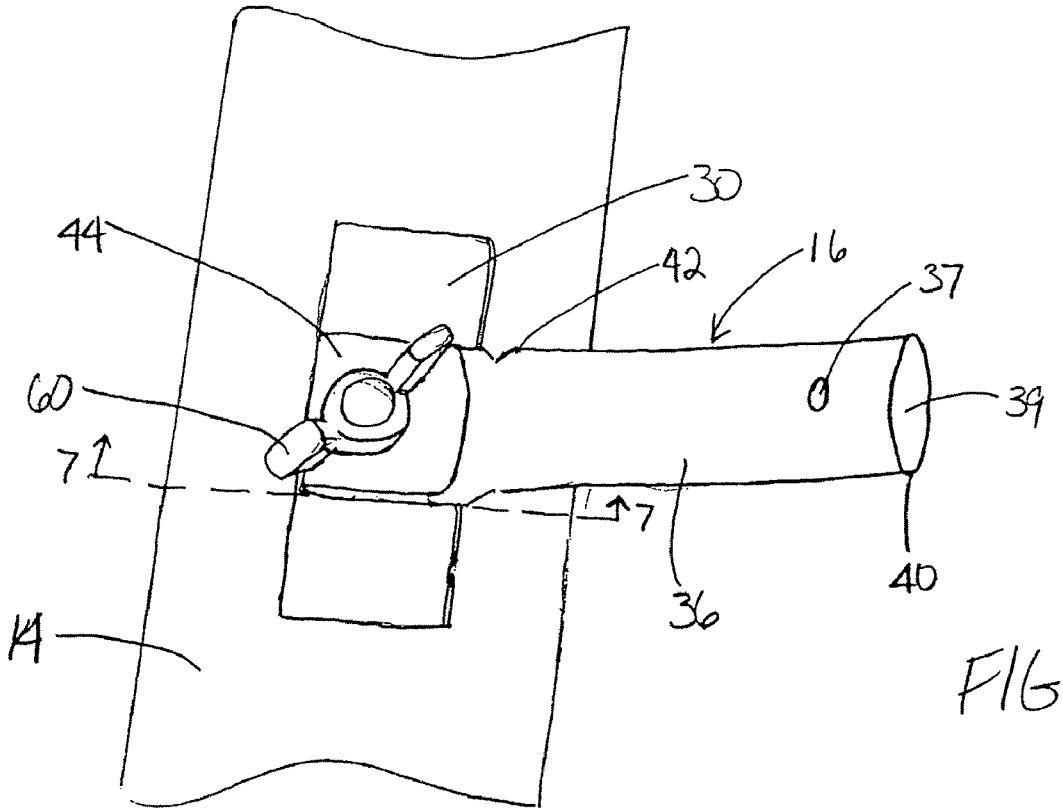
FIG. 6 is a top perspective view of the bracket assembly and portion of the broom head of the push broom of FIG. 1.
Figure 7:
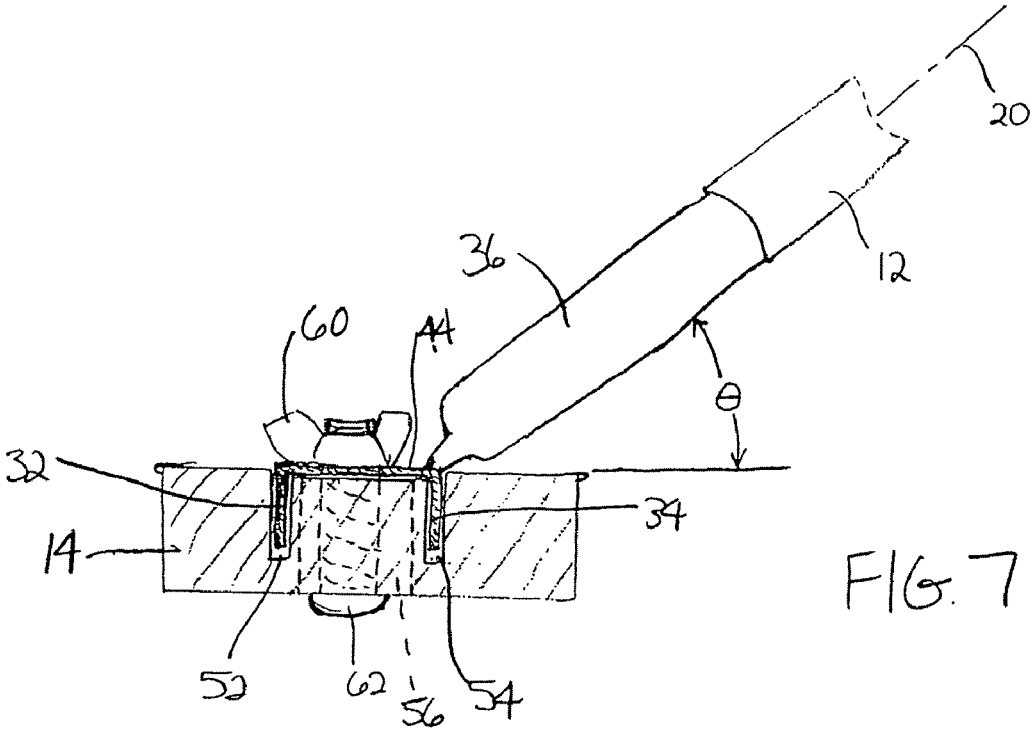
FIG. 7 is a cross-sectional view of an embodiment of push broom assembly taken along line 7-7 of FIG. 6.

Referring also to FIGS. 6 and 7, the bracket assembly 16 includes a handle connector 13, such as a mounting sleeve 36, which extends from the bracket assembly. It should be noted that although the handle connector 13 is depicted here as a mounting sleeve 36, the handle connector 13 may be of any other suitable configuration to allow the handle 12 generally to be mounted to the broom 10. By way of example, an end of the handle 12 may fit about the handle connector 13. The handle connector may be joined to the plate through a known fastening method such as bonding or welding or riveting. In certain embodiments, the handle connector 13 may include a tab 44 extending from the proximal end 42 of the mounting sleeve 36. The tab 44 and the plate 30 can be joined together by any suitable means, including bonding, welding, rivets and the like. In other embodiments, the handle connector 13 and the plate 30 may be a single piece construction and may be formed by casting or molding or machining.

In certain embodiments in which handle connector 13 includes a mounting sleeve 36, the mounting sleeve 36 has an opening 39 at its distal end 40. The mounting end 21 of the handle 12 is sized to fit within and extends into the opening 39 of the mounting sleeve 36. A pin, screw or other fastener (not shown) may be inserted through an opening 37 near the distal end 40 and into the handle 12 to removably secure the handle 12 in the mounting sleeve 36 and hold the handle 12 in place.

As also shown in FIG. 7, bolt 62 extends through the opening 56 and through the opening 38 of the plate 30. A nut 60, which may be, but is not limited to, a winged nut, on the end of the bolt 62 holds the bracket assembly 16 to the broom head 14. In an embodiment, the nut can be eliminated and opening 38 in the plate may be configured to mate with a fastener, such as a screw. As can be appreciated, however, other fasteners may also be used to connect the bracket assembly 16 and the broom head 14, such as, but not limited to, clips, screws and the like, and depending on the type of fastener the opening 38 may be omitted. Numerous methods are known to those of skill in the art for removably connecting a bracket to another object with a fastener and are contemplated as being within the scope of the invention.

As illustrated, mounting sleeve 36 (an embodiment of the handle connector 13-FIG. 3) and handle 12 extend outwardly from the broom head 14. The mounting sleeve 36 and handle 12 extend upwardly from the broom head 14 at an acute angle, indicated by $\theta$, relative to the top surface 15. The angle can be any angle that will allow the longitudinal axis 20 of the handle 12 to be positioned at an angle so that the push broom 10 is easily and comfortably pushed. The angle $\theta$ can be less than about 90°, preferably in a range of between about 10° to about 80°, and more preferably in a range between about 20° to about 50°.

In an embodiment, as depicted in FIGS. 3 and 7, to remove the bracket assembly 16 from the broom head 14 for replacement or rotation, the bolt 62 and nut 60 are loosened and the bracket assembly 16 removed from the receiving portion 50. The bracket assembly 16 is rotated 180° and the first and second flanges 32 and 34 inserted into the slots 54 and 52, respectively. The bolt 62 is re-inserted upwardly through the opening 56, and the nut 60 is tightened on the bolt 62 to securely connect the bracket assembly 16 and the broom head 14. As a result of the 180° rotation of the bracket assembly 16, the handle 12 extends in the opposite direction relative to the broom head 14. The rear face 72 of the broom head 14 thus becomes the leading face of the broom during sweeping and the front face 70 is rotated to the back of the broom.

In general, therefore, the bracket assembly 16 is configured to be releasably fastened to the broom head 14 in a first position. After unfastening the bracket assembly 16, it may be rotated around and again releasably fastened to the broom head 14. In this manner, different faces on the head of the cleaning implement can be set to face forward. In another aspect, cleaning implements having heads with differing widths or shapes can be used interchangeably with the bracket assembly 16. By generally standardizing the size and shape of the receiving portion 50 on the heads, the same bracket assembly 16 can be used with a variety of cleaning implement heads.

The present invention has been described in terms of preferred and exemplary embodiments thereof. Numerous other embodiments, modifications and variations within the scope and spirit of the appended claims will occur to persons of ordinary skill in the art from a review of this disclosure.

I claim:

1. A broom assembly comprising:

a broom head including a front face, a rear face, a first recessed portion, and a second recessed portion;

a bracket including a first downwardly extending flange, a second downwardly extending flange, and a handle connector, the first flange and the second flange being generally parallel to each other, the bracket is releasably mountable on the broom head in a forward and a reverse orientation;

an elongate handle;

wherein the broom head further includes a receiving portion, the bracket being nestably disposed in the receiving portion; and wherein the first downwardly extending flange is configured to be inserted into the first recessed portion and the second downwardly extending flange is configured to be inserted into the second recessed portion.

2. The broom assembly of claim 1, wherein the broom head includes a first opening and the bracket includes a second opening generally aligned with first opening, the assembly further including a fastener for releasably joining the bracket and the broom head, the fastener extending through the first and second openings.

3. The broom assembly of claim 2, wherein the fastener is configured to be unfastened manually without reliance on separate tools or other implements.

4. The broom assembly of claim 1, wherein the handle connector comprises a sleeve including an opening in a distal end, the opening configured to receive an end of the handle.

5. The broom assembly of claim 1, wherein the bracket comprises a plate having a first edge and a second edge opposite the first edge, wherein the two downwardly extending flanges extend from the respective first and second edges.

6. The broom assembly of claim 1, wherein the broom head includes a first opening and the bracket includes a second opening generally aligned with the first opening, the assembly further comprising a fastener disposable through the first and second openings for releasably mounting the bracket to the broom head.

7. A push broom assembly, comprising:

a broom head including a set of bristles extending from a bottom surface, first and second openings provided on a top surface, a first aperture extending through the broom head, the first aperture positioned between the first opening and the second opening;

a plate mountable on the broom head, the plate including a second aperture through a central region and first and second flanges extending from the plate, the first flange insertable into the first opening and the second flange insertable into the second opening;

a fastener extending through the first aperture in the broom head and the second aperture in the plate to join the broom head and plate; and an elongated handle extending from the plate;

the plate being mountable in a first position and a second position with respect to the broom head;

wherein the broom head includes a receiving portion and the plate and flanges are nestably disposed in the receiving portion.

8. The push broom assembly of claim 7, wherein the first and second flanges are substantially parallel to one another and substantially perpendicular to the plate.

9. The push broom assembly of claim 7, wherein an end of the handle is mounted in a sleeve extending from the plate.

10. The push broom assembly of claim 8, wherein the elongated handle is positioned at an angle between about 10 degrees to about 80 degrees from the top surface of the broom head.

* * * * *